US007290569B2

(12) United States Patent
Gesing

(10) Patent No.: US 7,290,569 B2
(45) Date of Patent: Nov. 6, 2007

(54) SHAFT ROD FOR WEAVING MACHINES

(75) Inventor: Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/959,122

(22) Filed: Oct. 7, 2004

(65) Prior Publication Data

US 2005/0109417 A1 May 26, 2005

(30) Foreign Application Priority Data

Oct. 7, 2003 (DE) ..... 103 46 399

(51) Int. Cl.
*D03C 9/06* (2006.01)

(52) U.S. Cl. ..... 139/91

(58) Field of Classification Search ..... 139/91–96, 139/82

See application file for complete search history.

(56) References Cited

U.S. PATENT DOCUMENTS

| | | | | |
|---|---|---|---|---|
| 3,754,577 A * | 8/1973 | Heller | | 139/92 |
| 3,901,282 A | 8/1975 | Kramer et al. | | |
| 4,492,256 A | 1/1985 | Kramer | | |
| 4,503,890 A * | 3/1985 | Kramer | | 139/92 |
| 4,633,916 A * | 1/1987 | Rast | | 139/92 |
| 4,913,193 A | 4/1990 | Faasse | | |
| 4,913,194 A * | 4/1990 | Kramer | | 139/91 |
| 5,232,025 A * | 8/1993 | Gysin et al. | | 139/92 |
| 5,871,035 A | 2/1999 | Kramer et al. | | |

FOREIGN PATENT DOCUMENTS

| | | |
|---|---|---|
| CH | 349556 | 11/1960 |
| DE | 33 23 224 C2 | 6/1983 |
| DE | 39 37 657 A1 | 11/1989 |
| DE | 198 39 465 A1 | 4/1999 |

* cited by examiner

*Primary Examiner*—Gary L. Welch
*Assistant Examiner*—Andrew W Sutton
(74) *Attorney, Agent, or Firm*—Norman N. Kunitz; Fitch, Even, Tabin & Flannery

(57) ABSTRACT

A shaft rod (2), wherein the heddle support rail (4) is secured in a form-fit to a profile body (9), for example in the form of an aluminum extruded profile, by projections (18) provided on the extrusion profile (9), with the projections 18 extending into substantially correspondingly shaped recesses (19) in the heddle support rail.

18 Claims, 5 Drawing Sheets

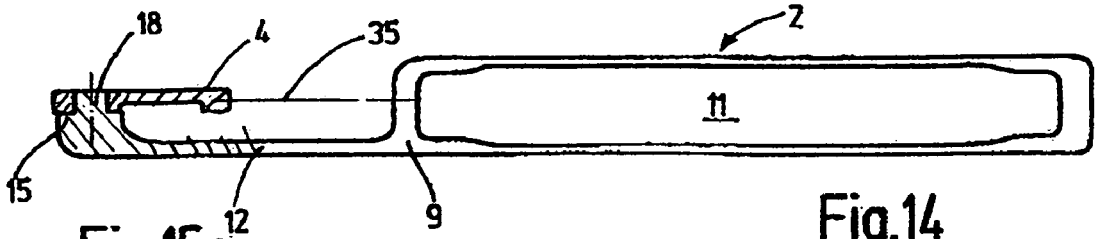
Fig.14
Fig.15a
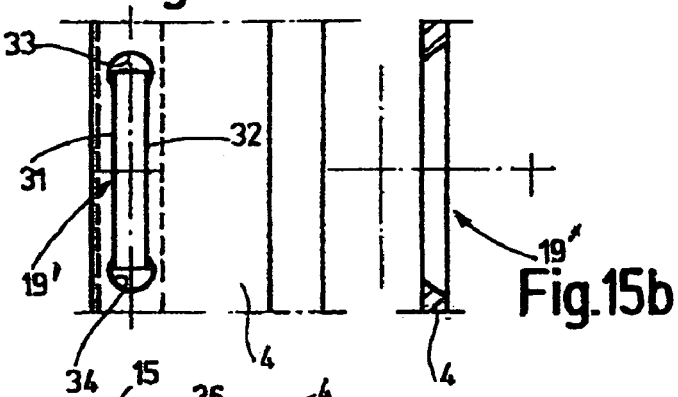
Fig.15b
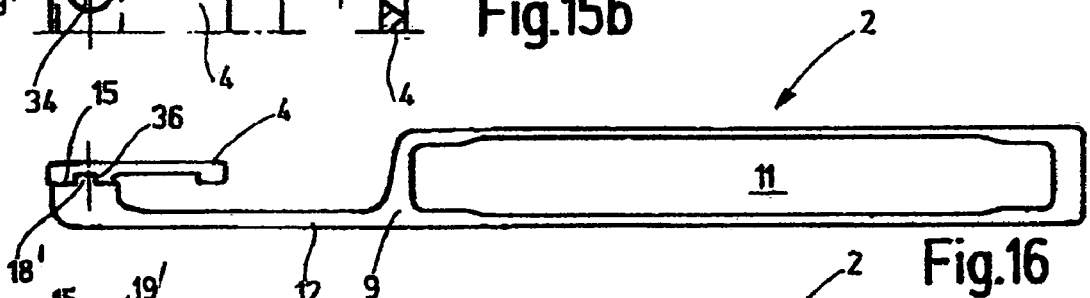
Fig.16
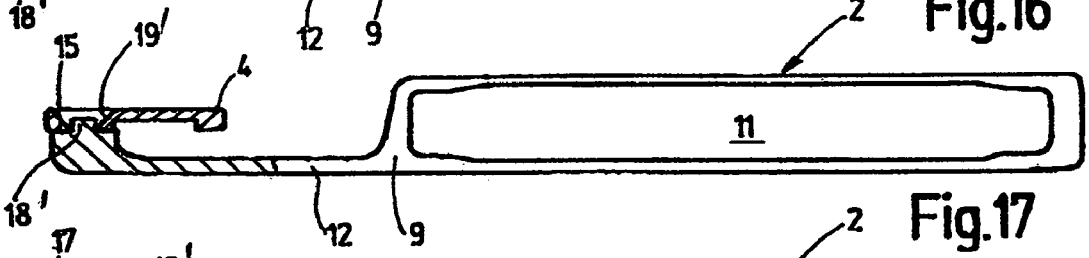
Fig.17
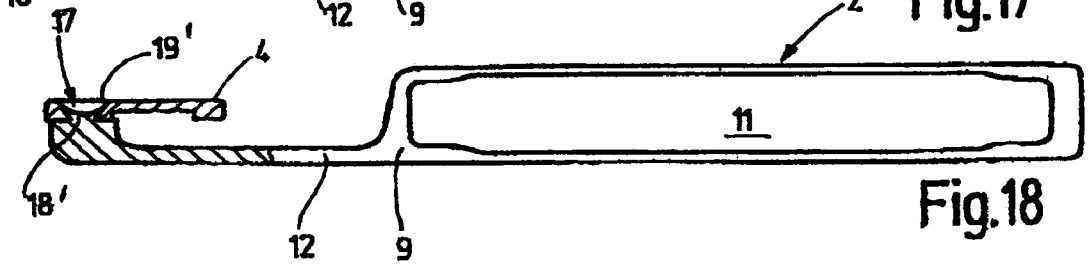
Fig.18
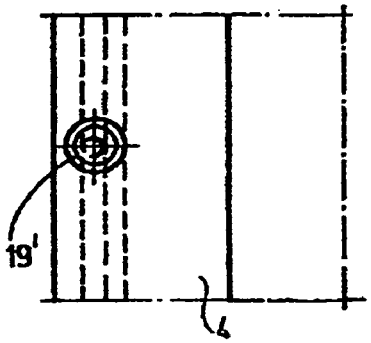
Fig.19

SHAFT ROD FOR WEAVING MACHINES

CROSS REFERENCE TO RELATED APPLICATION

This application claims the priority of German Patent Application No. 103 46 399.2, filed on Oct. 7, 2003, the subject matter of which, in its entirety, is incorporated herein by reference.

FIELD OF THE INVENTION

The invention relates to a shaft rod, particularly for a high-speed weaving machine.

BACKGROUND OF THE INVENTION

Shaft rods for weaving shafts are often created from light-metal profiles on which a steel heddle support rail is held. The heddle support rails are conventionally secured to the light-metal profile by a plurality of rivets that extend through the heddle support rail and a corresponding extension of the light-metal profile, thereby holding the heddle support rail in place. This securing system is limited. Care must be taken to prevent the shaft rods from being subjected to undesired bending during the riveting process, because otherwise the heddle play along the shaft rod will become non-uniform. It has also been seen that cracks often form in the region of the rivet bores, particularly at high operating speeds, and steel rivets are sheared off. The use of thicker steel rivets does not solve this problem, because they weaken the light-metal profiles to an unacceptable degree.

German printed Patent Application DE 39 37 657 A1 discloses a shaft rod for securing heddle support rails without rivets. The shaft rod has a wall-like, flat extension with two narrow, parallel ribs. The ribs define a slot-like receiving chamber between themselves. The associated heddle support rail has on its rear side a narrow retaining rib that is to be pushed into the receiving chamber. The rib has a certain amount of excess material, so it is seated in a press fit between the spread tabs or ribs of the retaining segment.

Forces exerted on the heddle support rail act as bending forces on the retaining ribs. At high operating speeds, the seating of the heddle support rail poses a problem.

German Patent DE 33 23 224 C2 discloses a shaft rod that is formed from a light-metal profile. To some extent, the rod replaces the conventional heddle support rail. The light-metal profile has a strip-like segment that is provided on its top side and underside with a U-shaped protective profile. Consequently, the precision of the heddle play is a function of the precision of the securing of the two U-profiles relative to one another. Many users therefore prefer conventional heddle support rails made from a suitable steel profile.

In view of the above problems, it is the object of the invention to create a shaft rod that is suitable for high operating speeds.

SUMMARY OF THE INVENTION

The above object generally is accomplished with a shaft rod in accordance with the invention that has a profile body with an extension for seating an extensively conventional heddle support rail. The extension is provided with at least one projection, but preferably with a plurality of projections that extend into corresponding recesses, e.g., bores, grooves, etc., of the heddle support rail. This avoids a stress concentration at individual locations of the heddle support rail that was discussed at the outset, and particularly occurs with the use of steel rivets. Unlike with steel rivets, which weaken progressively as the diameter of the shaft profile increases, with the shaft rod according to the invention an increase in the diameter or size of the projections does not lead to a weakening of the shaft profile. In addition, an increase in the size or diameter of the projection leads to a reduction in the local stress concentrations on the shaft profile. Therefore, comparatively larger forces can be transmitted from the heddle support rail to the shaft profile and from the shaft profile to the heddle support rail, which permits higher operating speeds.

The projections extending into the recesses of the heddle support rail can serve like rivets formed in one piece on the shaft profile, i.e., a unitary structure. In this instance, after the heddle support rail is positioned, the projections are plastically deformed in a free-end region to form a rivet head. Unlike in the use of steel rivets, however, this measure does not cause the profile body to warp, resulting in a high-precision shaft rod.

The profile body is preferably formed or embodied as a one-piece unitary light-metal profile body. It can be embodied as a hollow-chamber profile, in which case the hollow chambers may be empty or filled with foam. This can serve as a further reinforcement, or in vibration damping.

The recess or securing opening that receives the projection can be a bore, a slot, a groove or the like. The recess may serve solely in orienting the heddle support rail on the profile body, or additionally in securing it. In the latter case, at least a portion of the projection is deformed such that it holds the heddle support rail in a form-fit.

The projection is preferably connected to the profile body in one piece. It can be formed by, for example, pins that are glued, soldered or welded into corresponding bores, or tabs that are glued, soldered or welded into grooves, or it can be formed in one piece (unitary) with the profile body. In all of these cases, a good force transmission occurs without local force spikes. The seamless, one-piece embodiment is especially preferred, however. This embodiment is simple to produce and, due to the absence of a seam between the projection and the profile body and the homogeneous material constitution, it results in a good force transmission. It is also possible to round edges, for example in the transition from the projection to the remaining profile body, which counteracts stress spikes.

It is possible to utilize only the projections for orienting and securing the heddle support rail. Furthermore, the heddle support rail may be in a material-to-material connection with the shaft rod, for example glued to it.

Further details about advantageous embodiments of the invention ensue from the drawings, the description, and the claims.

The drawings illustrate embodiments of the invention.

BRIEF DESCRIPTION OF THE DRAWINGS

FIG. 14 is an end view, partially in cross-section, of a further modified embodiment of a shaft rod according to the invention.

FIG. 15*a* is a partial plan view of a first variation of the shaft rod according to FIG. 14.

FIG. 15*b* is a partial view, in longitudinal section, of a heddle support rail for a shaft rod according to FIG. 14.

FIGS. 16-18 are sectional views of a further modified embodiment of a shaft rod, in different lengthwise positions and in different manufacturing phases.

FIG. 19 a partial front view of the shaft rod according to FIG. 18.

DETAILED DESCRIPTION OF THE INVENTION

Figure 1:
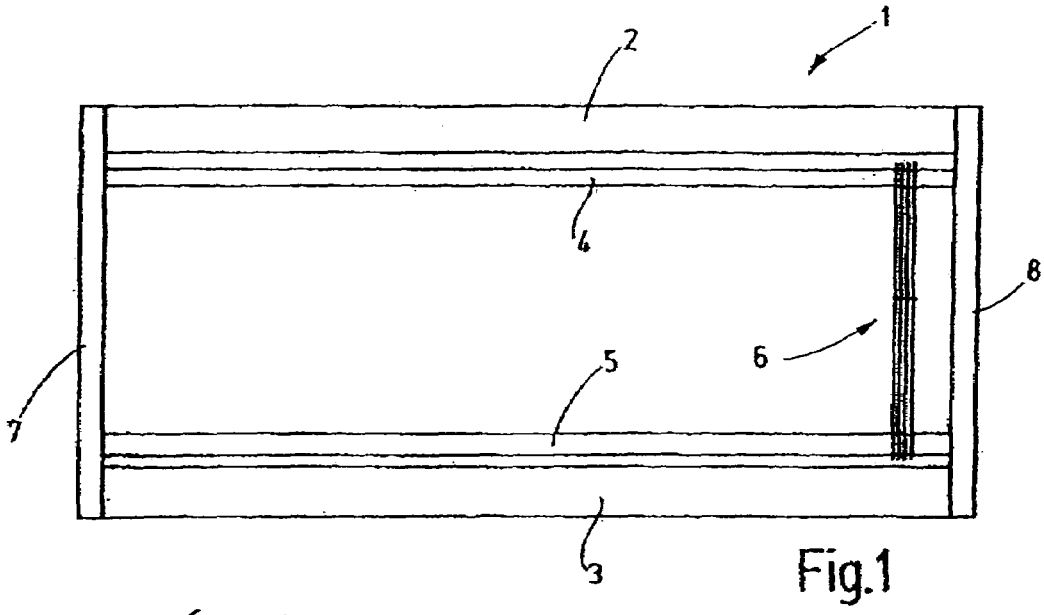
FIG. 1 is a schematic, front view of a weaving shaft.

FIG. 1 illustrates a weaving shaft 1 having an upper and a lower shaft rod 2, 3, respectively, with heddle support rails 4, 5, between which heddles 6 are held. Shaft rods 2, 3 are connected by lateral supports 7, 8 such that weaving shaft 1 forms a rectangular frame.

Shaft rods 2, 3 are essentially identical in structure. The following description of shaft rod 2 therefore also corresponds to shaft rod 3.

Figure 2:
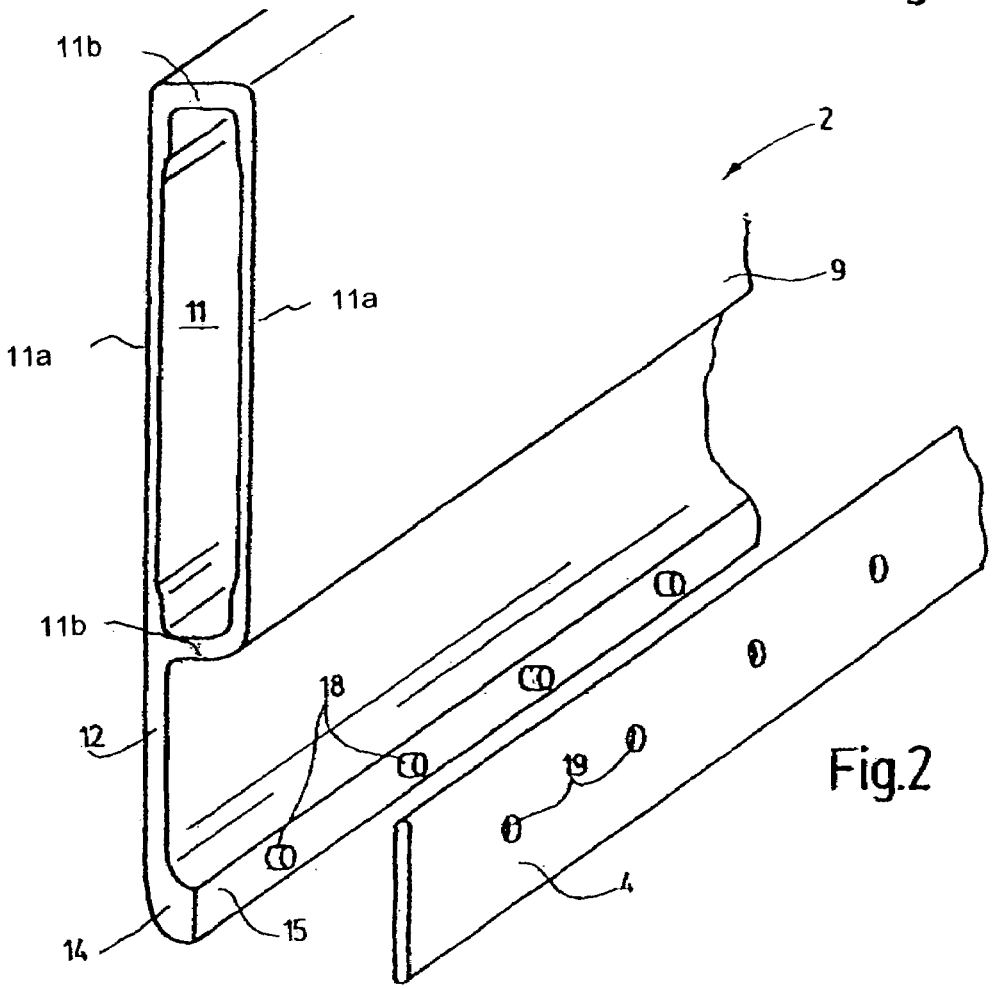
FIG. 2 illustrates a shaft rod according to the invention of the weaving shaft according to FIG. 1, in a perspective, exploded view.
Figure 3:
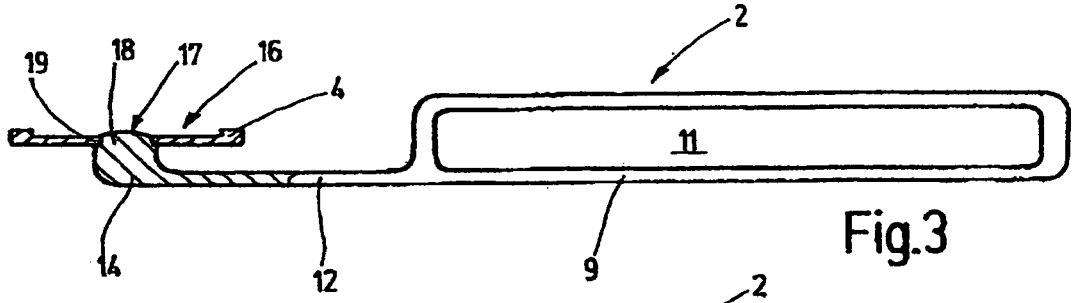
FIG. 3 is an end view, partially in cross-section, of the shaft rod according to FIG. 2.

Shaft rod 2 is shown separately and in an exploded view in FIG. 2. The rod 2 is formed by a profile body 9, such as an aluminum extruded profile body. Profile body 9 is preferably formed as a hollow-chamber profile that has one or more approximately rectangular chambers 11 and a narrow, rectangular cross-section formed essentially by two substantially parallel side walls 11*a* interconnected by at least one transversely extending end wall 11*b*. A wall region extends as an extension 12 from the portion of profile body 9 that surrounds chamber 11. The extension 12 is provided at its lower, free end with a curvature portion 14. The curvature portion 14 ends in a planar surface 15, which is oriented approximately parallel to the extension 12, but is offset from it, i.e., it is laterally spaced from the extension 12 so that it is located beneath the chamber 11. Planar surface 15 serves as a contact surface for the heddle support rail 4, which is configured, for example, as a flat steel profile having an approximately rectangular cross-section and rounded edges. As can be seen in FIG. 3, heddle support rail 4 can be provided on its surface facing away from extension 12 with depressions 16, for example, in the form of a longitudinal throughgoing groove or in the form of flat recesses that receive rivet heads 17. The rivet heads are formed on cylindrical, pin-like projections 18 that are formed in one piece, i.e., a unitary structure, on profile body 9 and extend perpendicular to planar surface 15. The region 18*a* (see FIG. 6), in which the cylindrical jacket surface of projection 18 meets planar surface 15 (FIG. 5), is preferably embodied or formed as a rounded channel.

Projections 18 may have a diameter that greatly exceeds that of conventional steel rivets. The diameter of projection 18 can correspond to the width of the segment of extension 12 formed by curvature portion 14, measured in the same direction, or it may be slightly smaller than this width. Heddle support rail 4 can therefore be riveted securely to extension 12 without the use of separate rivets by being brought close enough to extension 12 that its cylindrical securing openings 19 receive projections 18, as indicated in FIG. 2. The diameters of the pin-like projections 18 extensively match the diameter of securing openings 19, so heddle support rail 4 is seated without play, or with very little play, on projections 18. The length of projections 18 is selected such that they extend through securing openings 19, and protrude beyond them by a distance that suffices for forming a rivet head 17. For securing heddle support rail 4, the portion of projection 18 (protrusion) that extends through heddle support rail 4 is deformed. The necessary plastic deformation can be effected by a wobble riveting hammer, a pounding rivet hammer or the like. The rivet head 17 shown in FIG. 3 is a so-called round head whose height does not exceed the depth of depression 16.

Figure 4:
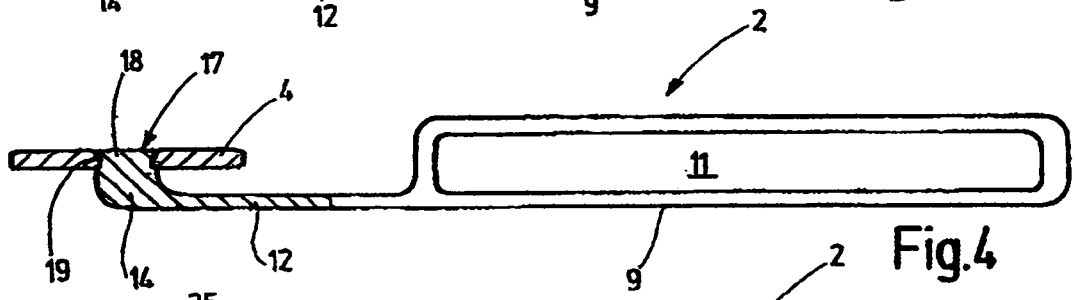
FIG. 4 is an end view, partially in cross-section, of a modified embodiment of the shaft rod according to FIG. 2.

As shown in FIG. 4, rivet head 17 can also be completely flat if heddle support rail 4 is embodied as a solid profile. In this case, securing opening 19 has a countersunk region on the surface opposite extension 12, which is filled with the material of the projection 18 when the projection is plastically deformed.

Projections 18 are preferably created in a metal-cutting process. That is, material is cut from regions completely surrounding planar surface 15, or from a somewhat narrow rib 25 (FIG. 5) to expose planar surface 15, until only projections 18 remain. Projections 18 are thus integral parts of profile body 9. The load transfer between heddle support rail 4 and profile body 9 is partly effected through frictional lockup between heddle support rail 4 and planar surface 15, and partly through shearing stress on projections 18. This is particularly the case because of the relatively exact fit between projections 18 and securing bores 19, and because of the large diameter of the bores. The shearing stress only causes small load spikes in the transition 18*a* between projections 18 and the rest of profile body 9. It is therefore possible to transmit large forces. A weaving shaft of this type can permit especially high operating speeds without rivets being torn off or rivet bores being stripped. The securing of heddle support rail 4 can also be supported by the application of adhesive to planar surface 15. As an alternative to the preferred, one-piece embodiment of projections 18, it is also possible to insert deformable pins into corresponding bores worked into the surface 15 of curvature portion 14, and glue them there. Pins of this type preferably comprise the same material as profile body 9 to permit a good load transfer.

FIGS. 5 through 8 illustrate a further exemplary embodiment of a shaft rod 2 in accordance with the invention. Identical reference numerals apply, with the exception of the differences discussed below.

Figure 5:
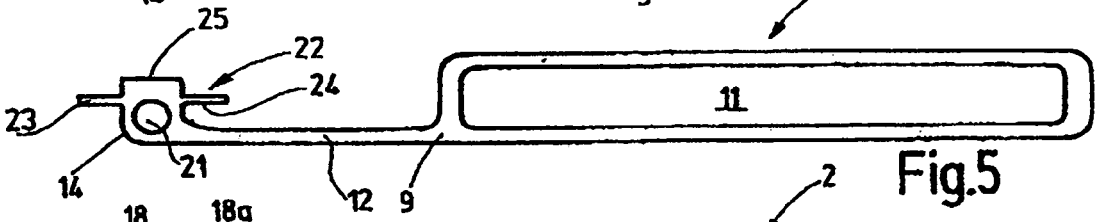
FIGS. 5-7 are end views, with FIG. 7 being partially in cross section, of a modified embodiment of the shaft rod according to the invention in different manufacturing phases.
Figure 6:
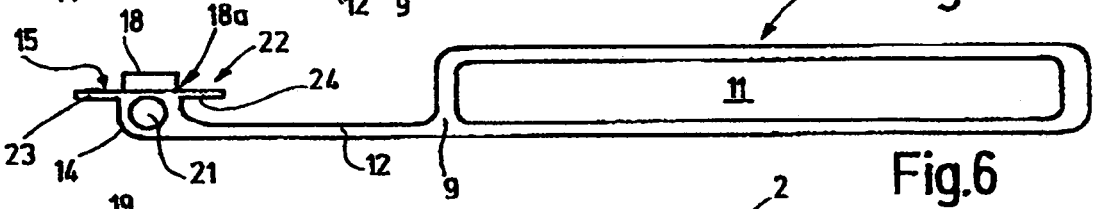
Figure 7:
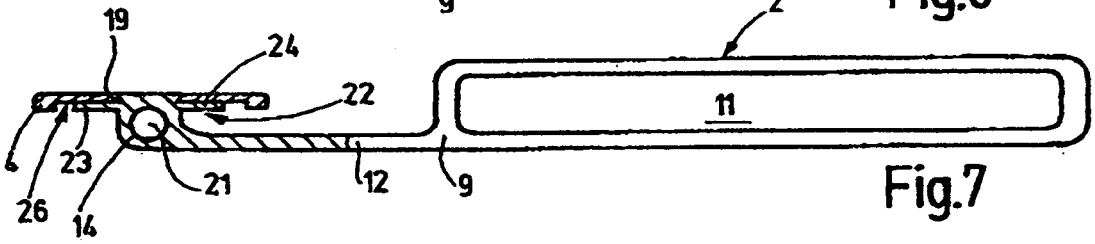
Figure 8:
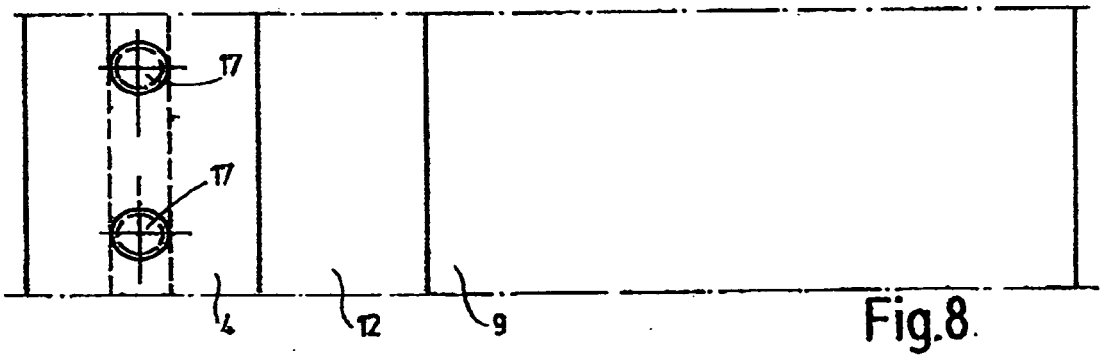
FIG. 8 is a partial front view of the shaft rod according to FIG. 7.

Profile body 9 of shaft rod 2 according to FIGS. 5 through 8 has a circular longitudinally extending channel 21 in its curvature portion 14, with the channel 21 effecting a weight reduction in the profile body 9 without notably weakening it. Adjoining the curvature portion 14 is a shield- or plate-shaped, strip-like region 22 that is formed by two thin, wall-like wings 23, 24 that lie in the same plane and are oriented parallel to extension 12. FIG. 5 illustrates profile body 9 as a blank. Wings 23, 24 have a certain overmeasure or oversize on their surface opposite extension 12. In an extension of curvature portion 14, a rib 25 rises above wings 23, 24. Projections 18 are created from rib 25 through milling of the oversurface of rib 25, with the overmeasure or excess thickness of wings 23, 24 also being milled off or otherwise removed through a machining process, thereby exposing planar surface 15. The machining creates planar surface 15, from which projections 18 protrude at a right angle, as shown in FIG. 6. The heddle support rail 4 shown in FIG. 7 can now be mounted, with the rail 4 being provided on its rear surface with, for example, a longitudinally throughgoing, flat, groove-like recess 26, into which wings 23, 24 fit. The depth of recess 26 matches the thickness of wings 23, 24, or is slightly larger than it. Securing openings 19 are countersunk, so a plastic deformation of projections 18 serves to fill the recess and thus provide a form-fitting seating of heddle support rail 4. FIG. 8 is a plan view of the formed rivet heads 17. The advantage of this embodiment lies in the enlargement of the surface area of planar surface 15, which offers a good orientation of heddle support rail 4, on the one hand, and a higher frictional lockup between heddle support rail 4 and profile body 9, on the other hand. If needed, adhesive can be applied in the seam formed between planar surface 15 and heddle support rail 4, which secures the rail more reliably and makes the load transfer more uniform.

Figure 9:
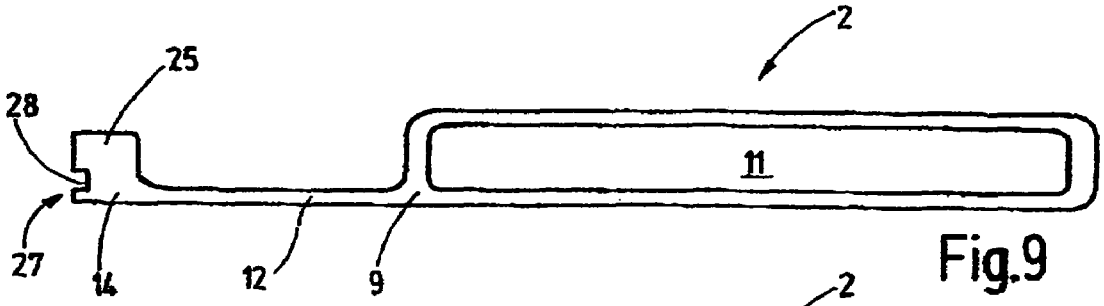
FIGS. 9-12 are end views, with FIGS. 11 and 12 being partially in cross-section, of a modified embodiment of a shaft rod according to the invention in different manufacturing phases.
Figure 10:
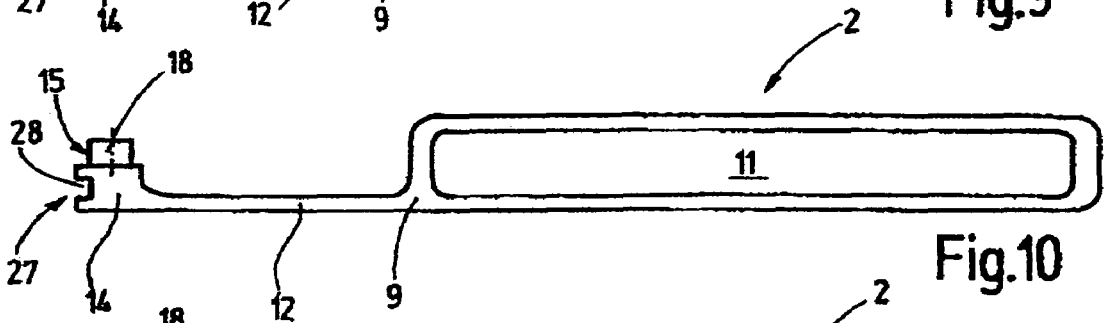
Figure 11:
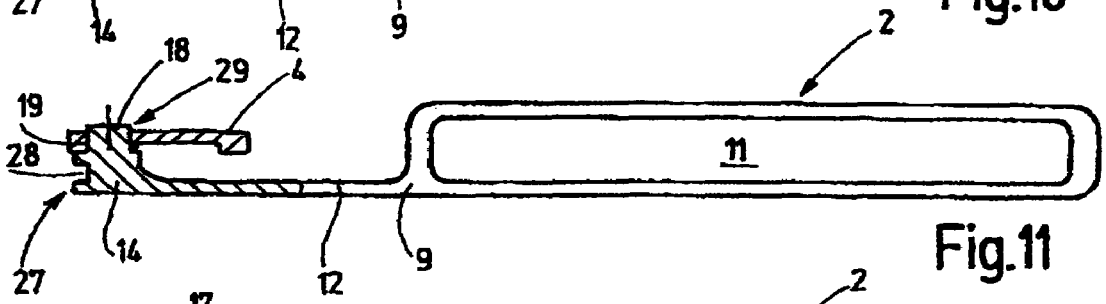
Figure 12:
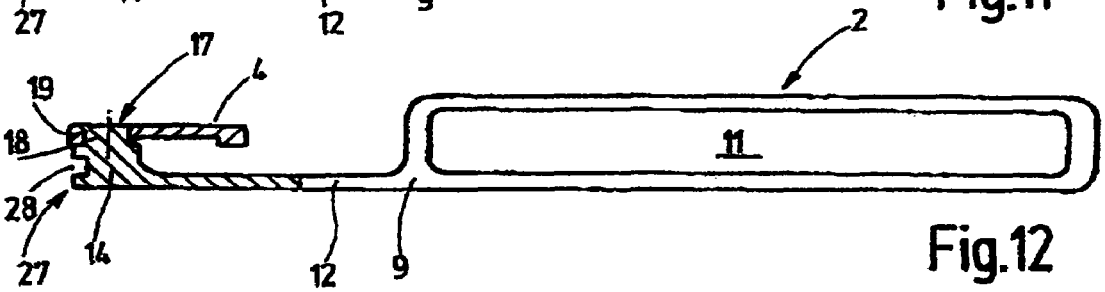
Figure 13:
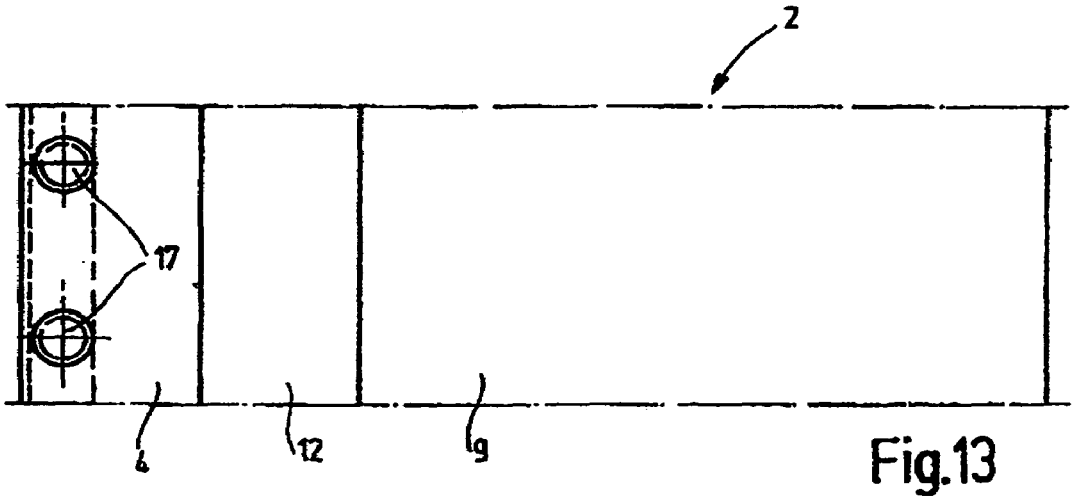
FIG. 13 is a partial front view of the shaft rod according to FIG. 12.

The manner of securing heddle support rail 4 to profile body 9 as described above is not limited to securing symmetrical heddle support rails for heddles having C-shaped end eyelets, but is also applicable to securing asymmetrical heddle support rails, e.g. for heddles having J-shaped end eyelets. FIGS. 9 through 13 depict an exemplary embodiment of this type. In this instance, the above description and reference numerals apply, with the following additional description:

In the region of curvature portion 14, an essentially flat end surface 27 that extends perpendicular to extension 12 is provided on profile body 9. A groove 28 can be cut into this surface. The shape of this groove 28 and the position of surface 27 can be defined through a metal-cutting process to ensure dimensional accuracy. FIG. 9 shows a blank of profile body 9, in which the region of curvature portion 14 changes over to a rib 25 preferably having about the same width. The width (length) of this rib 25, which extends away from extension 12 at a right angle, is greater than the thickness of extension 12 by a multiple. In a machining step, a portion of rib 25 is removed, with cylindrical, parallel, uniformly-spaced projections 18 being shaped, that is, being left behind. FIG. 10 depicts this machining phase. As is apparent, the machining process also creates planar surface 15, from which projections 18 protrude. Projections 18 are cut to the same length in the machining process, as in all of the above-described exemplary embodiments. After heddle support rail 4 has been mounted, the projections 18 protrude slightly past the outer surface of the rail 4, as shown in FIG. 11. In a subsequent rivet-machining procedure, the protrusion 29 of projection 18 that passes through securing opening 19 is plastically deformed, so the countersunk region of securing bore 19 is completely filled as rivet head 17 is formed, as shown in FIG. 12. Rivet heads 17 are preferably round in plan view, as can be seen in FIG. 13.

Adhesive can also be applied to planar surface 15 to support the connection with heddle support rail 4.

FIGS. 14 through 19 illustrate further embodiments of the shaft rod 2 according to the invention. As is apparent, these embodiments can be used equally well for asymmetrical or symmetrical heddle support rails 4. The foregoing descriptions of exemplary embodiments apply in conjunction with the following explanations, with the reference numerals being identical.

In the exemplary embodiment shown in FIGS. 14 and 15, profile body 9 has elongated projections 18' on its planar surface 15, the projections being rectangular in plan view and having associated with correspondingly oblong securing openings 19' in heddle support rail 4. In this embodiment, the length of projection 18' (measured perpendicular to extension 12) matches the thickness of heddle support rail 4, and the projection 18' has a rectangular perimeter (FIG. 15*a*). The projection 18' thus forms a tab-like structure with a rectangular cross-section. Securing opening 19' has two opposite planar surfaces 31, 32 that rest against the flanks of projection 18' and define a slot between themselves, the width of which matches the width of projection 18'. At the ends, the slot 19' can be closed off by corresponding cylindrical wall segments 33, 34. Securing opening 19 can be produced in a stamping process (FIG. 15*a*) or a milling process (FIG. 15*b*).

The stem-shaped projection 18' can serve to transmit forces exerted at a right angle to heddle support rail 4. The direction of the force exertion is indicated by a dot-dash line 35 in FIG. 14. Heddle support rail 4 can be secured to extension 12 with adhesive. The low-play or play-free fit between projections 18' disposed in a row one behind the other and heddle support rail 4, which has corresponding securing openings 19' disposed in a row one behind the other, can serve to hold the heddle support rail 4 until the adhesive in the seam between heddle support rail 4 and planar surface 15 has hardened. The fit between projection 18' and securing opening 19' can be formed as a transition fit or a press fit. In the use of fast-drying adhesives, however, and/or if projections 18' are subjected to a plastic deformation after heddle support rail 4 has been mounted, or if at least temporary means such as clamps or the like are provided to secure heddle support rail 4 until the adhesive dries, a clearance fit can also be used.

FIGS. 16 through 19 illustrate a further embodiment of the shaft rod, in which projection 18' is embodied as a longitudinally throughgoing rib that projects from planar surface 15 and preferably possesses a rectangular cross-section. As can be seen from FIG. 16, heddle support rail 4 has a groove 36 that complements projection 18' and extends over the rear surface of heddle support rail 4 resting on support surface 15. Groove 36 extends over the entire length of heddle support rail 4. It is about one-half of the thickness of heddle support rail 4. As shown in FIGS. 17, 18 and 19, approximately conical securing openings 19 that intersect groove 36 are formed in heddle support rail 4. When heddle support rail 4 is mounted on planar surface 15, projection 18' secures heddle support rail 4 against displacement. The rectangular projection or rib 18' extends through securing opening 19 without securing heddle support rail 4 in place, as shown in FIG. 17. With the use of a suitable pressing tool, projection 18' can be deformed in the region of securing openings 19' such that it at least fills the lower region of the opening, as shown in FIG. 18. A sort of rivet head 17 is formed from the tab-like projection 18, and presses heddle support rail 4 against planar surface 15. Heddle support rail 4 is therefore secured in a form-fit with extension 12. In addition, a material-to-material securing method can be implemented, such as the use of adhesive or the like.

The embodiment of shaft rod 2 discussed here has the advantage that forces exerted on heddle support rail 4 in the longitudinal direction of heddle support rail are transmitted to profile body 9 over the entire length of the rib forming projection 18'.

Figure 20:
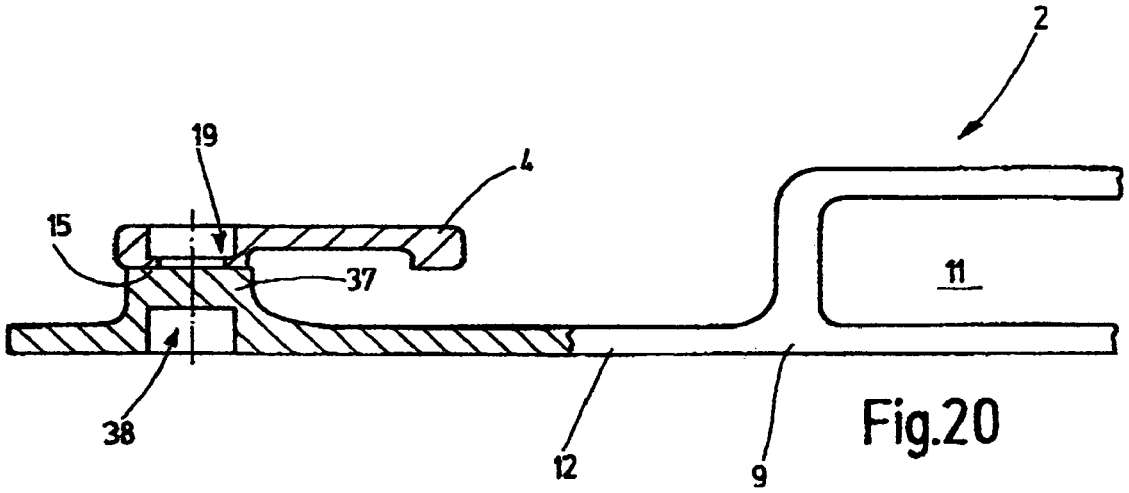
FIGS. 20-22 are end views, partially in cross-section, of a further modified embodiment of a shaft rod according to the invention in different manufacturing phases.
Figure 21:
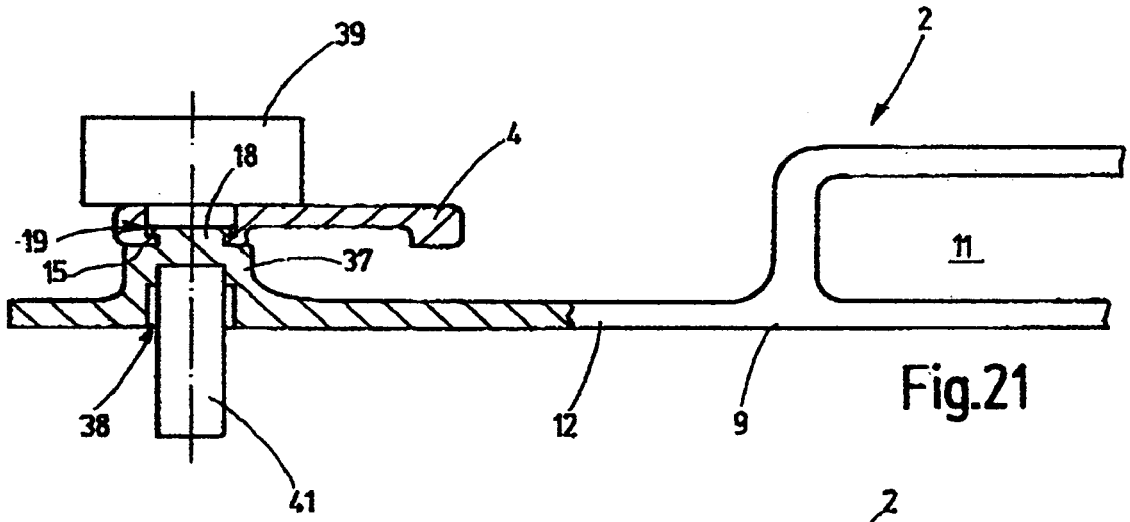
Figure 22:
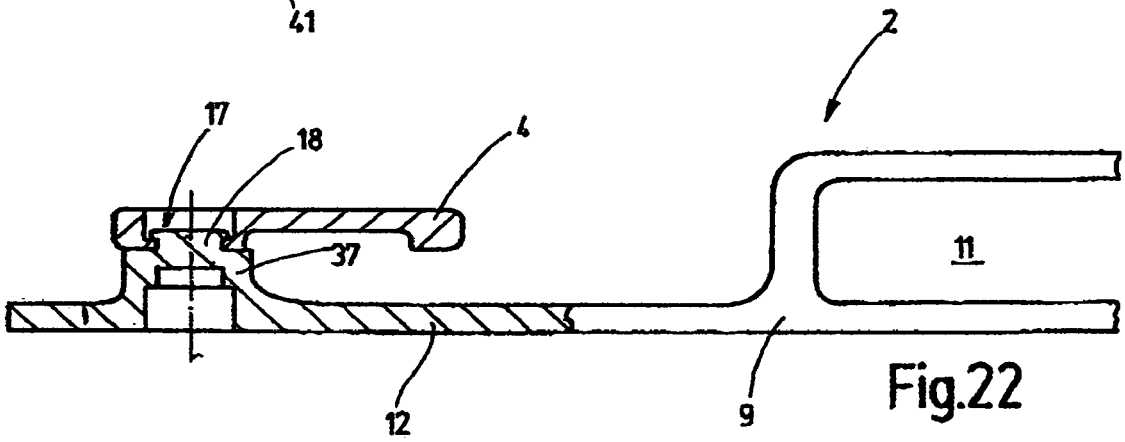

FIGS. 20 through 22 depict a further embodiment of the invention. The same reference numerals as in the above description apply here. In this instance, however, projections 18 for securing heddle support rail 4 are not cut out of rib 25 (FIG. 5), and also not directly molded, as can be the case in the embodiment according to FIGS. 16 through 19, but they are formed in an extrusion process shown in FIGS. 21 and 22. The starting point is the profile body 9 shown in FIG. 20, which has a support rib 37 that is formed on extension 12 for supporting heddle support rail 4 and has approximately the same function as curvature portion 14. Support rib 37 is provided on its surface facing heddle support rail 4 with planar surface 15. One or more depressions 38 that extend into support rib 37 can be formed on the rear surface of extension 12, that is, in the surface facing away from heddle support rail 4. Depressions 38 can be individual blind bores, groove segments or a longitudinally throughgoing groove.

Securing opening 19 is likewise formed as a stepped bore, whose narrower cross-section faces planar surface 15.

Heddle support rail 4 is secured to profile body 9 in an extrusion process, which is shown in FIG. 21. A counter-punch or anvil 39 is inserted into securing opening 19 of heddle support rail 4, and preferably fills the larger diameter of securing opening 19 completely, such that the lower surface of the anvil 39 and the planar surface 15 define a chamber with a T-shaped longitudinal section. From the rear side, a pressure piston 41 is inserted into depression 38 and pressed in such that it pushes in the material at the bottom of depression 38, which plastically deforms in the process. Consequently, on the opposite side, a mushroom-shaped projection 18 that protrudes at the end surface of anvil 39 moves into securing opening 19. The upper portion of projection 18 forms the rivet head 17 visible in FIG. 22.

A common feature of all of the above-described embodiments is that the absence of bores in profile body 9 eliminates stress spikes in the mounting region of heddle support rail 4, which significantly increases the durability of shaft rod 2. Moreover, it is not necessary to include bores, which would weaken the cross-section of the profile. That is, bores would otherwise be required for rivets or the like. The shaft rod is about 10% more rigid, and bends less under a load. In addition, the profile cross-section can be scaled down in the region of the rivet head, which can reduce the weight of the shaft rod by about 3%.

When projections 18 are crushed or pressed, the shaft rods become less curved in comparison to conventional riveting procedures. In conventional procedures, a buckled rivet can press the bore of the profile cross-section laterally, causing the positioning of the heddle support rail to be imprecise. These drawbacks are avoided with the invention. If the heddle support rail 4 is glued to the profile body 9, the gluing process can be simplified. The milled rivets or other anchoring means can serve in adjusting the support rail while the adhesives dry.

It will be appreciated that the above description of the present invention is susceptible to various modifications, changes and adaptations, and the same are intended to be comprehended within the meaning and range of equivalents of the appended claims.

What is claimed is:

1. A shaft rod for a high-speed weaving machine comprising: a profile body having an extension for securing a heddle support rail, with the extension having at least one projection that is an integral one-piece part of the extension; and a heddle support rail that is provided with at least one recess into which a respective projection of a substantially corresponding shape extends; the recess is a groove formed in a surface of the heddle support rail that faces the extension and extends along the length of the heddle support rail; and at least one conical through bore is disposed in the rail in communication with the groove and into which a cylindrical free end portion of the projection extends.

2. The shaft rod according to claim 1, wherein the projection has a deformed segment that contacts a portion of an outer surface of the heddle support rail around the recess to connect the projection to the rail.

3. The shaft rod according to claim 1, wherein the projection is disposed within the recess without play.

4. The shaft rod according to claim 1, wherein the projection extends away from a substantially planar contact surface against which a surface of the heddle support rail rests.

5. The shaft rod according to claim 1, wherein the heddle support rail is connected to the shaft rod via an adhesive.

6. A shaft rod for a high-speed weaving machine comprising: a profile body having spaced substantially parallel sidewalls interconnected by at least one transversely extending end wall, and an integral extension extending in a direction substantially parallel to the sidewalls for securing a heddle support rail, with the extension having at least one transversely extending rigidly connected projection of the same material as the body and being an integral one-piece part of the extension; and a heddle support rail that is provided with at least one recess into which a respective projection of a substantially corresponding shape extends.

7. The shaft rod according to claim 1, wherein the profile body is a light-metal profile body.

8. The shaft rod according to claim 6, wherein the recess is a bore.

9. The shaft rod according to claim 8, wherein the bore extends completely through the heddle support rail and is countersunk at the surface of the rail adjacent a free end of the projection; and the free end of the projection is deformed to extend into the countersunk portion of the bore.

10. The shaft rod according to claim 6, wherein the recess is a slot.

11. The shaft rod according to claim 10, wherein the slot has a rectangular shape.

12. The shaft rod according to claim 6, wherein the recess is a groove formed in a surface of the heddle support rail that faces the extension.

13. The shaft rod according to claim 12, wherein: the groove extends along the length of the heddle support rail; and at least one conical through bore is disposed in the rail in communication with the groove and into which a cylindrical free end portion of the projection extends.

14. The shaft rod according to claim 13, wherein the free end portion is deformed to engage at least a portion of the surface of the conical bore, and fill at least a portion of the conical bore, to secure the heddle support rail to the projection.

15. The shaft rod according to claim 6, wherein the projection extends away from a substantially planar contact surface of the extension and against which a surface of the heddle support rail rests.

16. The shaft rod according to claim 15, wherein the heddle support rail is connected to the extension of the shaft rod via an adhesive disposed between the substantially planar surface and the heddle support rail.

17. The shaft rod according to claim 6, wherein the recess extends completely through the heddle support rail and the projection extends beyond an outer surface of the support rail and is has a free end that is broadened by deformation to contact the outer surface of the support rail and connect the heddle support rail to the extension.

18. The shaft rod according to claim 6, wherein: the recess is a groove formed in a surface of the heddle support rail that faces the extension and extending along the length of the heddle shaft rail, with at least one through bore being disposed in the rail in communication with the groove; and the projection includes a first portion that extends through the bore and is deformed to engage an outer surface of the heddle support rail and a pair of wings that extend in opposite directions from the first portion and are disposed in the groove.

* * * * *